US011754238B2

(12) United States Patent
Hierzer

(10) Patent No.: US 11,754,238 B2
(45) Date of Patent: Sep. 12, 2023

(54) LIGHTING ARRANGEMENT

(71) Applicant: H4X e.U., Graz (AT)

(72) Inventor: Andreas Hierzer, Graz (AT)

(73) Assignee: H4X e.U., Graz (AT)

( * ) Notice: Subject to any disclaimer, the term of this patent is extended or adjusted under 35 U.S.C. 154(b) by 0 days.

(21) Appl. No.: 17/700,691

(22) Filed: Mar. 22, 2022

(65) Prior Publication Data

US 2022/0307661 A1 Sep. 29, 2022

(30) Foreign Application Priority Data

Mar. 25, 2021 (DE) ..... 102021202974.4

(51) Int. Cl.
*F21S 8/04* (2006.01)
*F21S 4/28* (2016.01)
(Continued)

(52) U.S. Cl.
CPC ..... *F21S 8/043* (2013.01); *F21S 2/005* (2013.01); *F21S 4/28* (2016.01); *F21S 8/038* (2013.01);
(Continued)

(58) Field of Classification Search
CPC ... F21V 21/35; F21S 2/005; F21S 4/28; F21S 8/038
See application file for complete search history.

(56) References Cited

U.S. PATENT DOCUMENTS 6,933,444 B2 8/2005 Albert et al.
9,615,414 B2 4/2017 Hamamoto
(Continued)

FOREIGN PATENT DOCUMENTS

CN 110762496 A 2/2020
DE 3812465 A1 10/1989
(Continued)

OTHER PUBLICATIONS

Machine translation of Zumtobel Lighting GmbH, DE 202014100258U1, published Jun. 3, 2015 (Year: 2015).*
(Continued)

*Primary Examiner* — William N Harris
(74) *Attorney, Agent, or Firm* — MILLEN, WHITE, ZELANO & BRANIGAN, P.C.; William F. Nixon; Wan-Ching Montfort

(57) ABSTRACT

A lighting arrangement includes a first lighting module and a second lighting module. A rail is designed for coupling or at least partially accommodating the first lighting module and the second lighting module. A conductor device is provided along the rail in order to provide electric current and a control signal. The first lighting module is configured to be coupled to the conductor device to receive electric current for supplying the first lighting module and the control signal from the conductor device. The first lighting module is configured to process the control signal and to control the first lighting module in dependence upon the control signal. The first and the second lighting module are configured to be coupled to one another such that a signal for controlling the second lighting module can be communicated from the first lighting module to the second lighting module.

21 Claims, 5 Drawing Sheets

(51) Int. Cl.

| | |
|---|---|
| ***F21S 2/00*** | (2016.01) |
| ***F21V 23/06*** | (2006.01) |
| ***F21V 21/005*** | (2006.01) |
| ***F21V 21/35*** | (2006.01) |
| ***F21V 23/00*** | (2015.01) |
| ***F21S 8/00*** | (2006.01) |
| ***F21Y 103/10*** | (2016.01) |
| ***F21Y 115/10*** | (2016.01) |

(52) U.S. Cl.
CPC ..... *F21V 21/005* (2013.01); *F21V 21/35* (2013.01); *F21V 23/003* (2013.01); *F21V 23/06* (2013.01); *F21Y 2103/10* (2016.08); *F21Y 2115/10* (2016.08)

(56) References Cited

U.S. PATENT DOCUMENTS

| | | | | |
|---|---|---|---|---|
| 9,845,942 | B2 | 12/2017 | Ladstaetter | |
| 9,982,875 | B2 | 5/2018 | Stevens | |
| 10,323,837 | B2 | 6/2019 | Hierzer | |
| 10,746,358 | B1 | 8/2020 | Palfreyman et al. | |
| 2011/0242811 | A1* | 10/2011 | Cheng | F21S 4/28 362/249.03 |
| 2012/0287671 | A1* | 11/2012 | Parker | G02B 6/0085 362/613 |
| 2014/0049954 | A1 | 2/2014 | Ladstaetter | |
| 2014/0362574 | A1 | 12/2014 | Barrett | |
| 2016/0195250 | A1* | 7/2016 | Park | F21S 8/038 362/219 |
| 2018/0172257 | A1* | 6/2018 | Hierzer | F21V 5/043 |
| 2018/0202643 | A1* | 7/2018 | Wang | F21S 4/28 |
| 2019/0170334 | A1* | 6/2019 | Stucchi | F21V 23/06 |
| 2020/0263861 | A1 | 8/2020 | Carney et al. | |

FOREIGN PATENT DOCUMENTS

| | | | |
|---|---|---|---|
| DE | 102011017702 | A1 | 10/2012 |
| DE | 202014100258 | U1 | 4/2015 |
| DE | 202014100258 | U1 | 6/2015 |
| DE | 102015214487 | A1 | 3/2016 |
| EP | 1349437 | B1 | 5/2010 |
| EP | 3336420 | A1 | 6/2018 |
| WO | 2014195801 | A2 | 12/2014 |
| WO | 2015136080 | A1 | 9/2015 |

OTHER PUBLICATIONS

Search report in corresponding EP 22 16 2307 dated Apr. 12, 2022 (pp. 1-3).

Search report in corresponding Austrian application 50243/2021 dated Jul. 22, 2022 (1 page).

* cited by examiner

LIGHTING ARRANGEMENT

FIELD OF THE INVENTION

The invention relates to a lighting arrangement comprising a rail.

TECHNICAL BACKGROUND

The use of rails for lighting purposes, for instance lighting purposes in buildings, is known. Furthermore, e.g. systems have already been proposed, in which electrical conductors are integrated into a rail profile to provide a supply voltage and control signals. Such rail systems include e.g. a number of light insets of a different type, e.g. spotlights or linear light insets, which can also be combined.

Furthermore, e.g. EP 3 336 420 B1 describes a lighting system which comprises a channel for accommodating a lighting unit which can be inserted therein. A connector which can be inserted into the channel is provided in order to electrically couple conductor rail sections to one another. The lighting system of EP 3 336 420 B1 is intended to achieve e.g. a slender design and the creation of attractive light strips with a small installation depth and width.

Nowadays, controllability of the illuminating components of lighting arrangements is greatly desired, e.g. in terms of dimming. However, electrical and electronic components for achieving controllability are often costly and make lighting arrangements more expensive.

SUMMARY OF THE INVENTION

Against this background, the object of the invention is to provide a lighting arrangement comprising a rail which permits a modular structure, can be produced at reduced cost and at the same time makes good controllability of illuminating components possible.

In accordance with the invention, this object is achieved by a lighting arrangement having the features of claim 1.

A lighting arrangement is proposed, comprising a first lighting module and at least one second lighting module, and comprising a rail which is designed for coupling and/or at least partially accommodating the first lighting module and the at least one second lighting module. A conductor device is provided along the rail in order to provide electric current and a control signal.

The first lighting module is configured to be coupled to the conductor device in order to receive electric current for supplying the first lighting module and the control signal from the conductor device. Furthermore, the first lighting module is configured to process the control signal, in particular to interpret it, and to control the first lighting module in dependence upon the control signal.

The first and the at least one second lighting module are configured to be coupled to one another such that a signal for controlling the at least one second lighting module can be communicated from the first lighting module to the at least one second lighting module.

One idea addressed by the invention resides in the fact that in this manner a lighting arrangement comprising a rail and lighting modules can be provided, in which not all lighting modules have to be equipped with relatively costly devices for processing a control signal, in particular in terms of interpreting same. In an advantageous manner, e.g. the second lighting module can be manufactured more cost-effectively, since comparatively expensive electronic components can be saved in this case. At the same time, a modular structure of the lighting arrangement and good controllability are rendered possible. Optionally, the at least one second lighting module can be configured to be coupled to a third lighting module in such a way that the signal for control can be communicated to the third lighting module, wherein the third lighting module can be designed e.g. in the same way as the second lighting module.

Advantageous embodiments and developments of the invention are apparent from the further dependent claims and from the description with reference to the figures.

In one embodiment, the at least one second lighting module can be controlled together with the first lighting module according to a master-slave principle, wherein the at least one second lighting module as the slave is subordinate to the first lighting module as the master. The control of the at least one second lighting module can thus be achieved in a simple manner.

In a development, the first lighting module has an electronic arrangement, by means of which the control signal received from the conductor device can be processed, in particular interpreted, and the first lighting module can be controlled depending upon the control signal. In particular, the signal to be communicated to the at least one second lighting module can be provided by means of the electronic arrangement. Therefore, one or more complex and expensive electronic components on the second lighting module can be saved and/or the complexity of an electronic arrangement on the second lighting module can be reduced.

In one embodiment, the at least one second lighting module is configured to be coupled to the conductor device in order to receive electrical energy for supplying the at least one second lighting module from the conductor device. Therefore, the conductor device can also be used by the at least one second lighting module for the supply of power.

In one embodiment, the first lighting module has a first contact device, by means of which one or more operating current provisioning conductors of the conductor device can each be contacted in an electrically conductive manner. Furthermore, in this embodiment the first lighting module has a second contact device, by means of which one or more control signal provisioning conductors of the conductor device can each be contacted in an electrically conductive manner.

In one embodiment, the control signal which can be provided at the conductor device, in particular at the control signal provisioning conductors, can be a DALI signal. However, the use of other control methods or alternative dimming methods is likewise feasible in other embodiments.

In one embodiment, the at least one second lighting module has a third contact device, by means of which the operating current provisioning conductor(s) of the conductor device can each be contacted in an electrically conductive manner. Therefore, by being directly coupled to the operating current provisioning conductors, the at least one second lighting module can use said conductors for the supply of energy, while the signal for controlling the second lighting module is provided by the first lighting module.

According to one embodiment, provision is made that the first lighting module and/or the at least one second lighting module each have a printed circuit board and that the contact devices comprise contact elements arranged in an elastically movable manner on the printed circuit board, wherein the contact elements are each arranged in the region of a respectively allocated recess in an edge of the printed circuit board. In particular, provision can be made that the contact elements protrude through openings of a housing component of the lighting module on one or both longitudinal sides thereof from an outer side of the lighting module. In this way, the contact devices can be arranged in a space-saving manner, and in addition, the supply voltage and the control signal can arrive where they are used, processed, interpreted or converted, in particular without unnecessary diversions. In addition, reliable contacting of the conductors is possible in this way.

In one development, the conductor device has at least two operating current provisioning conductors and two control signal provisioning conductors, wherein provision can be made in particular that the operating current provisioning conductors and control signal provisioning conductors are arranged symmetrically with respect to a longitudinal centre plane of the rail. This can facilitate e.g. the design and arrangement of the contact devices and the housing components.

According to one development, the first lighting module and the at least one second lighting module are each designed as a lighting inset. Furthermore, in this development provision is made that the conductor device is arranged in an inner region of the rail and the lighting insets can be inserted into the inner region of the rail.

In one embodiment, when the lighting modules are in the inserted state, the conductor device is arranged laterally of the lighting modules, in particular on both sides of the lighting modules. This contributes to space-saving design.

In one embodiment, the contact elements of each of the contact devices are arranged symmetrically on both longitudinal sides of the lighting module. This can also contribute to facilitating the production of the lighting modules.

In a development, the first lighting module and the at least one second lighting module are each designed having at least one connecting device, wherein the connecting devices of the first and the at least one second lighting module are designed to correspond to one another and the second lighting module can be connected by means of the connecting devices to the first lighting module for the purpose of transmitting the signal for the control of the second lighting module.

In one embodiment, the connecting devices are each arranged at an end-face end of the first or at least one second lighting module. This is particularly advantageous for slender, elongate and elegant lighting modules which are to be accommodated and coupled with a small space requirement, e.g. in a rail.

In a development, the connecting devices are designed as plug connecting devices, e.g. as a male plug connector and an allocated female plug connector. Therefore, a simple and reliable connection of the lighting modules is achieved. For example, provision can be made that the lighting modules, in a state coupled to the rail and/or accommodated in the rail, can be connected by means of the connecting device in such a way that the lighting modules are displaced towards one another. For example, plug connections are very suitable for this purpose.

In one embodiment, the connecting devices of the first and at least one second lighting module are each arranged on the printed circuit board. Diversions in the connection of the two lighting modules can thus be avoided, and this configuration also contributes to space savings and expedient producibility.

In one embodiment, the first and at least one second lighting module can be inserted into the inner region of the rail from a lower side of the rail in an intended mounting state of the rail, wherein in this embodiment the rail can be mounted e.g. along a ceiling.

In one development, the first lighting module and the at least one second lighting module are each elongate, preferably slender. Such lighting modules can be used advantageously e.g. to create attractive and narrow modular light strips.

In one development, the first lighting module and the at least one second lighting module are each linear. However, other forms are also feasible.

In particular, in one embodiment the rail is designed as a low-voltage rail.

In one embodiment, the first lighting module and the at least one second lighting module are each formed using the chip-on-board method with one strip-like lighting device or a plurality of strip-like lighting devices. In particular, when designing the rail and the lighting modules e.g. in the form of lighting insets, with small dimensions and spacing, the use of strip-like lighting devices, such as LEDs, in the chip-on-board ("COB") method can contribute advantageously to avoiding visible light spots and ensuring uniform light emission and an attractive effect.

In one development, the lighting arrangement can have a plurality of first lighting modules and/or a plurality of second lighting modules.

In a further embodiment, the lighting arrangement has a plurality of second lighting modules which are coupled to the first lighting module in each case directly or indirectly such that the signal for controlling the second lighting modules can be communicated in each case from the first lighting module to the second lighting modules.

In a further embodiment, the lighting arrangement can have more than one first lighting module, wherein at least one of the first lighting modules is coupled to at least one second lighting module for communicating the signal for controlling the second lighting module from the first lighting module to the second lighting module. In particular, in one development a multiplicity of first lighting modules can be provided which can each be coupled to at least one second lighting module.

The above embodiments and developments can be combined with each other in any manner if it is useful to do so. Further possible embodiments, developments and implementations of the invention also comprise non-explicitly-mentioned combinations of features of the invention which have been described or will be described hereinafter with reference to the exemplified embodiments. In particular, in this regard a person skilled in the art will also add individual aspects as improvements or complements to the respective basic form of the present invention.

CONTENT OF THE DRAWING

The invention will be explained in more detail hereinafter with the aid of the exemplified embodiments shown in the schematic figures of the drawings. In the drawings.

Figure 1:
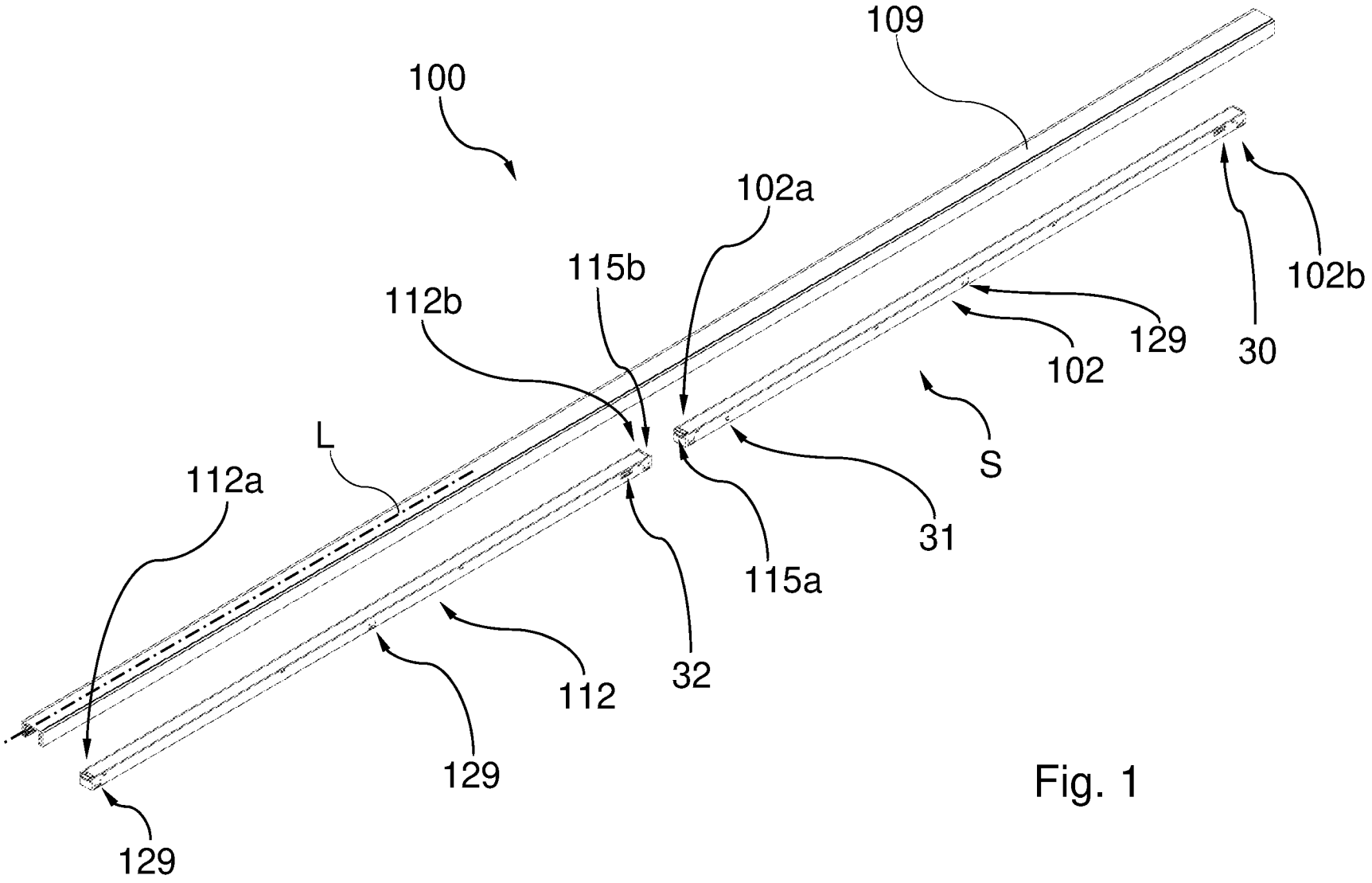
FIG. 1 shows a view of a rail and two lighting modules of a lighting arrangement according to one exemplified embodiment, seen in perspective from a rear side facing away from a visible side.
Figure 2:
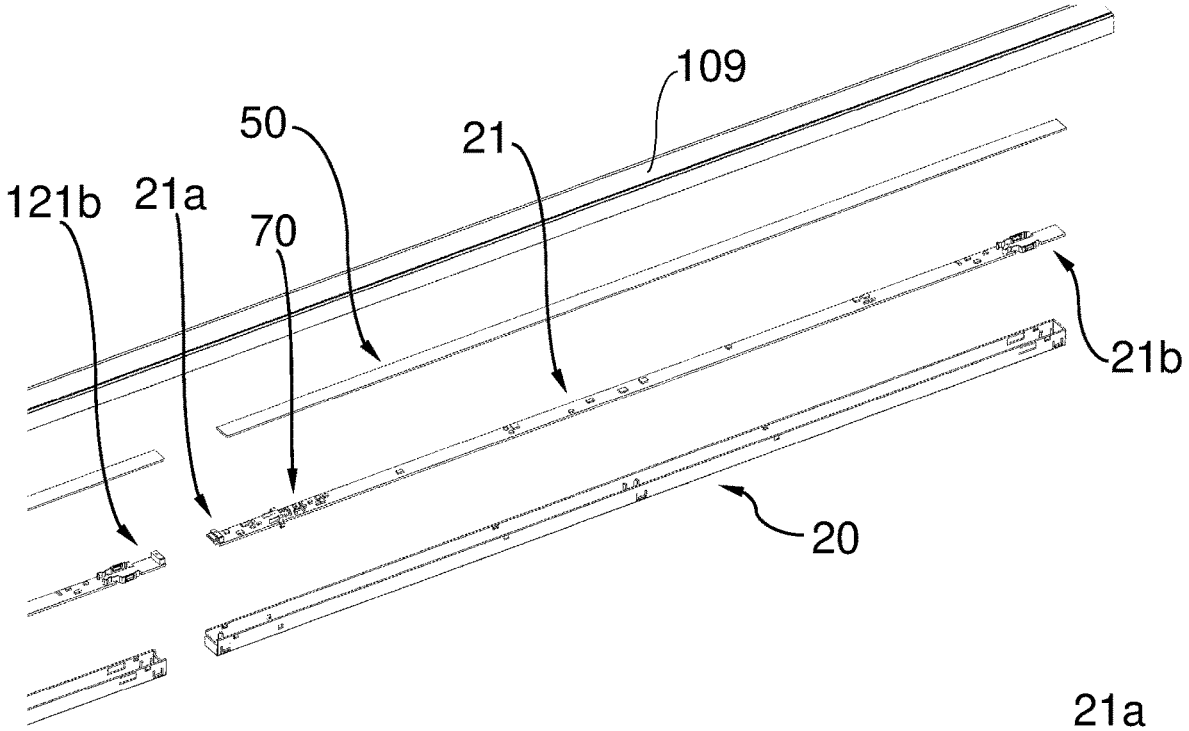
FIG. 2 shows a perspective exploded view of a first one of the lighting modules, together with a portion of the rail, corresponding to the right half of FIG. 1.
Figure 3:
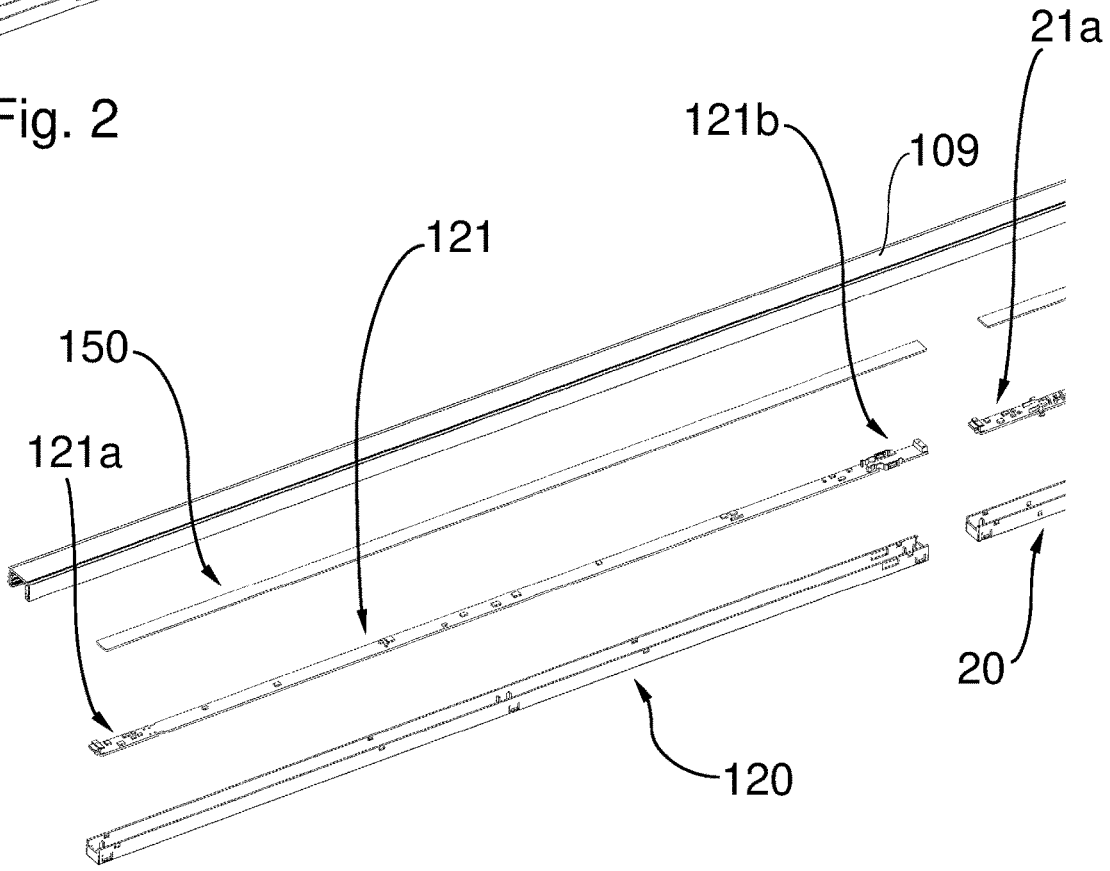
FIG. 3 shows a perspective exploded view of a second one of the lighting modules, together with another portion of the rail, corresponding to the left half of FIG. 1.
Figure 4:
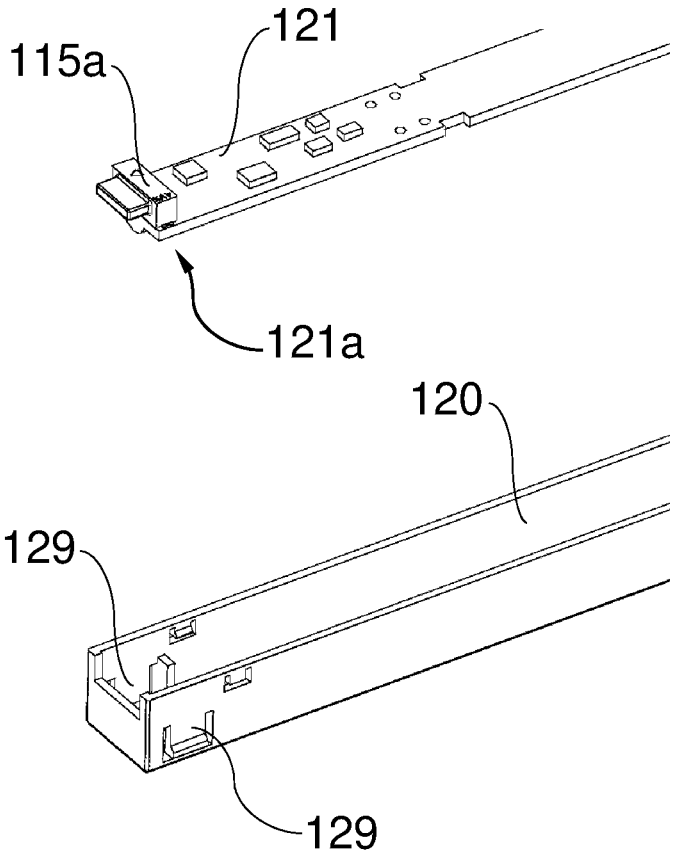
FIG. 4 shows end regions of a printed circuit board and a housing component of the second lighting module of FIG. 3.
Figure 5:
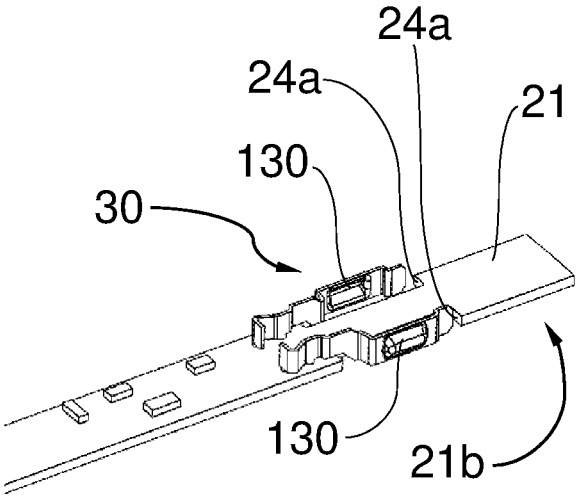
FIG. 5 shows end regions of a printed circuit board and a housing component of the first lighting module of FIG. 2.
Figure 5:
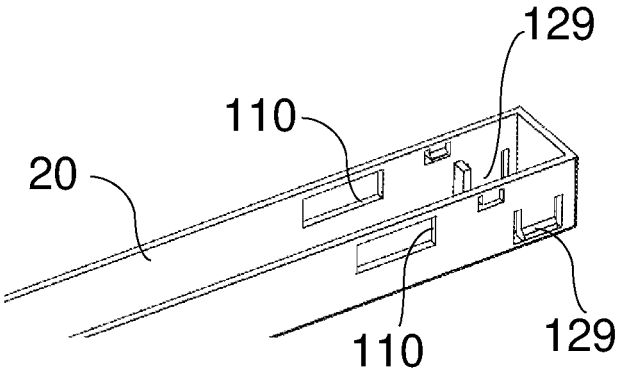
Figure 6:
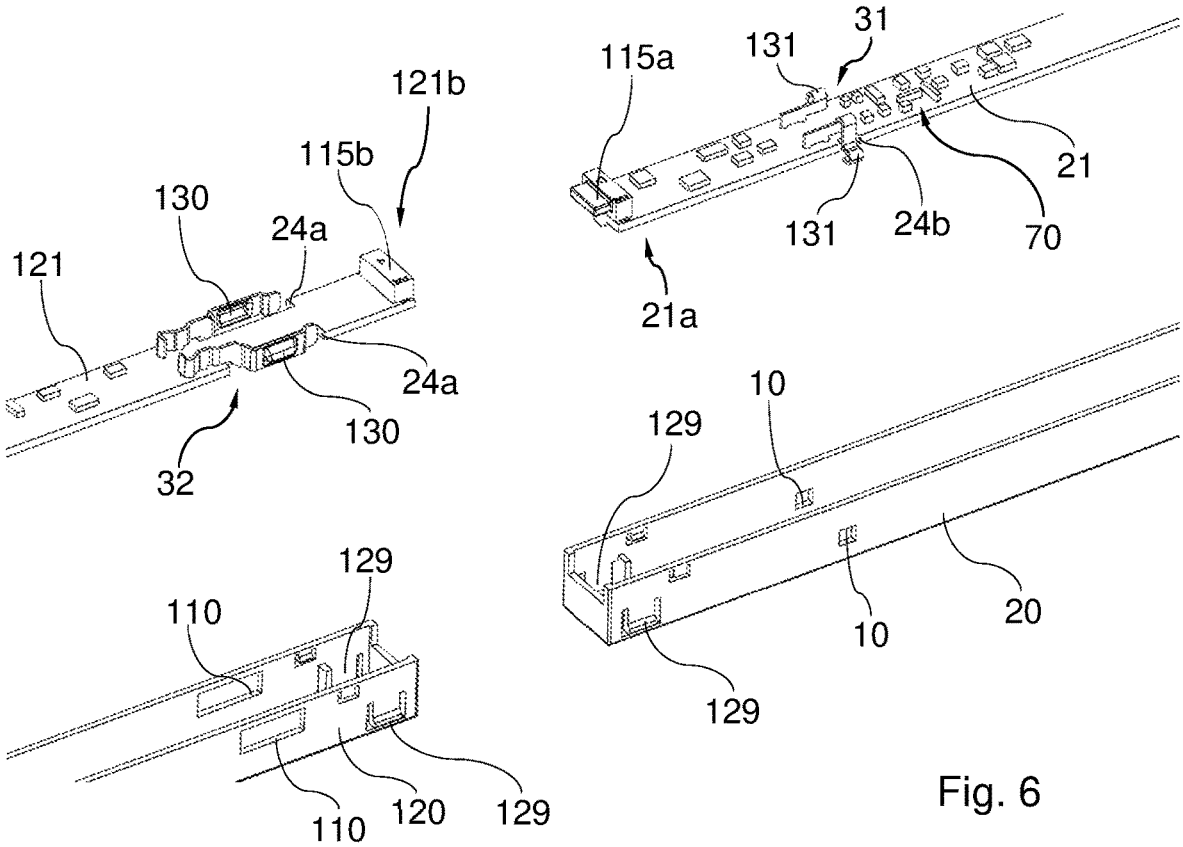
FIG. 6 shows other end regions of the printed circuit board and the housing component of the first and second lighting modules respectively according to FIGS. 2 and 3, in a region in which the lighting modules can be coupled to one another each other, being adjacent to each other.

The attached drawings are intended to provide improved understanding of the embodiments of the invention. They illustrate embodiments and serve, in conjunction with the description, to explain principles and concepts of the invention. Other embodiments and many of said advantages will be apparent in view of the drawings. The elements in the drawings are not necessarily illustrated to scale with respect to each other.

In the figures, like and functionally identical elements, features and components and elements, features and components acting in an identical manner are provided with the same reference signs, unless indicated otherwise.

DESCRIPTION OF EXEMPLIFIED EMBODIMENTS

A lighting arrangement 100 according to one exemplified embodiment of the invention is described hereinafter with reference to FIGS. 1-8.

The lighting arrangement 100 has in each case two linear, slender and elongate lighting modules 102 and 112, as well as a rail 9 which is designed in particular as a low-voltage rail. The lighting modules 102, 112 are each designed as a lighting inset for insertion into an inner region 125 of the rail 109, wherein the lighting modules 102, 112 are accommodated in the inner region 125 of the rail 109 and are coupled to the rail 109.

In particular, the lighting arrangement 100 can comprise, in variants, more than one second lighting module 112 in addition to the first lighting module 102, e.g. two second lighting modules 112 can be arranged adjoining one another along a longitudinal extension L of the rail 109 to a first lighting module 102. It is also feasible to have an even larger number of second lighting modules 112 which are allocated to the first lighting module 102.

In particular, the lighting arrangement 100 can be designed as a slender and attractive, modular light strip.

The lighting modules 102, 112 can be inserted into the rail 109 from an open side thereof in a direction transverse to the longitudinal direction L of the rail 109.

The rail 109 can be mounted e.g. in the region of a ceiling of a room along the ceiling. In such a mounting state of the rail 109, the lighting modules 102, 112 can be inserted into the rail 109 from a lower side thereof, corresponding to a visible side S, see FIGS. 1, 7, 8.

Figure 7:
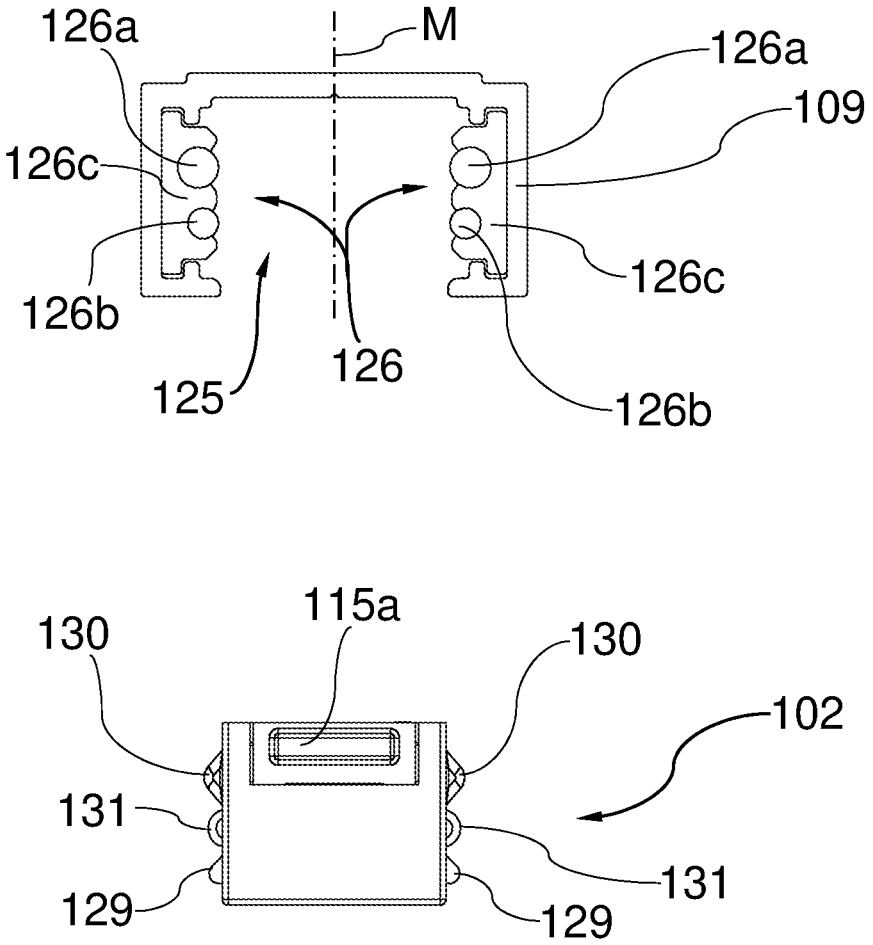
FIG. 7 shows an end view of the rail and the first lighting module according to the exemplified embodiment, before inserting the first lighting module into the rail.
Figure 8:
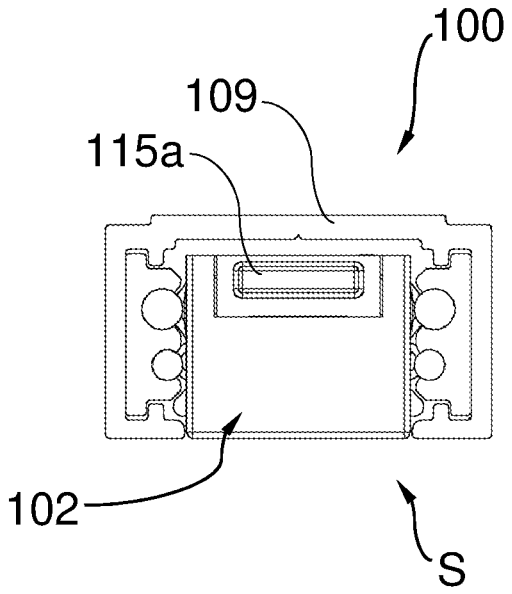
FIG. 8 shows an end view of the rail and the first lighting module according to the exemplified embodiment, after inserting the first lighting module into the rail.

The rail 109, see FIGS. 7, 8, is formed in cross-section having a substantially inverted U-shaped profile which is symmetrical to a longitudinal centre plane M of the rail 109 and has a web, flanges and an inner region 125.

A conductor device 126 is arranged along the rail 109 in the inner region 125. The conductor device 126 is formed in two parts with two base bodies 126*c* arranged laterally in the inner region 125 and a total of two operating current provisioning conductors 126*a* and two control signal provisioning conductors 126*b*. In this case, the conductors 126*a*, 126*b* are arranged symmetrically with respect to the longitudinal centre plane M, wherein an operating current provisioning conductor 126*a* and a control signal provisioning conductor 126*b* are accommodated in each of the base bodies 126*c*. In this manner, the conductor device 126 permits the provision of electric current and a control signal. The operating current provisioning conductors 126*a* are designed to provide a low electric voltage, e.g. <60 volts.

For example, a DALI signal or alternatively a signal based on another protocol or control method, for instance another dimming method, can be provided at the control signal provisioning conductors 126*b*.

When the lighting modules 102, 112 are in the state inserted into the rail 109, the conductor device 126 is arranged in a space-saving manner in each case laterally of the lighting modules 102, 112 on both sides of the lighting modules, see FIGS. 7 and 8.

The first lighting module 102 has an elongate housing component 20, an elongate printed circuit board 21 and an elongate cover 50.

The second lighting module 112 has an elongate housing component 120, an elongate printed circuit board 121 and an elongate cover 150.

The housing components 20, 120 are each box-like with an open top side, are each e.g. completely or at least partially translucent, and are configured to accommodate the printed circuit board 21 or 121. After the printed circuit board 21, 121 has been accommodated, the housing components 20, 120 can be closed by means of the respectively allocated cover 50, 150 in order to form the lighting modules 102, 112.

The first lighting module 102 has a first end-face end 102*a* and a second end-face end 102*b*. The second lighting module 112 has a first end-face end 112*a* and a second end-face end 102*b*. In FIG. 1, the first end 102*a* of the first lighting module 102 and the second end 112*b* of the second lighting module 112 are adjacent to one another after insertion of the modules 102, 112.

In order to mechanically fasten the lighting modules 102, 112, the housing components 20, 120 have elastically resilient clip elements 129 on the longitudinal sides thereof, some of which are respectively adjacent to the ends 102*a, b* or 112*a, b* of the lighting modules 102, 112, others are arranged, by way of example, along the longitudinal extent of each of the modules 102, 112 approximately in the centre thereof.

Adjacent to the second end 102*b*, the first lighting module 102 has a first contact device 30. The contact device 30 is designed having two contact elements 130 arranged symmetrically on both longitudinal sides of the lighting module 102, wherein the contact elements 130 are configured to make electrically conductive contact in each case with one of the operating current provisioning conductors 126*a*. The contact elements 130 are designed having resilient sections which are each fastened to the printed circuit board 21, see FIG. 5. The contact elements 130 are each partially arranged in the region of a recess 24*a* in the edge of the printed circuit board 21 and can deflect into the recess 24*a* in a resiliently movable manner.

In longitudinal walls of the housing component 20, said housing component has mutually opposing openings 110, through which in each case one of the elements 130 protrudes from an outer side of the lighting module 102 after assembly of the lighting module 102.

Adjacent to the first end 102*b*, the first lighting module 102 has a second contact device 31. The contact device 31 is designed having two contact elements 131 arranged symmetrically on both longitudinal sides of the lighting module 102, wherein the contact elements 131 are each configured to make electrically conductive contact in each with one of the control signal provisioning conductors 126*b*. The contact elements 131 are designed having partially resilient sections which are each fastened to the printed circuit board 21, see FIG. 6. The contact elements 131 are each partially arranged in the region of a recess 24*b* in the edge of the printed circuit board 21 and can deflect into the recess 24*b* in a resiliently movable manner.

In longitudinal walls of the housing component 20, said housing component has mutually opposing openings 10, through which in each case one of the elements 131 protrudes from an outer side of the lighting module 102 after assembly of the lighting module 102.

The first lighting module 102 also has a plug connecting device 115*a* which is arranged at the end 102*a* and is designed by way of example as a male plug connector. One end 21*a* of the printed circuit board 21 corresponds to the end 102*a* of the lighting module 102 when said lighting module is in the assembled state. The connecting device 115*a* is arranged on and fastened to the printed circuit board 21 at the end 21*a*.

Adjacent to the second end 112*b*, the second lighting module 112 has a third contact device 32. Similarly to the first contact device 30 of the lighting module 102, the contact device 32 of the second module 112 is designed having two contact elements 130 arranged symmetrically on both longitudinal sides of the lighting module 112, wherein the contact elements 130 are configured to make electrically conductive contact in each case with one of the operating current provisioning conductors 126*a*. The contact elements 130 are designed having resilient sections which are each fastened to the printed circuit board 121, see FIG. 6. The contact elements 130 of the contact device 32 are each partially arranged in the region of a recess 24*a* in the edge of the printed circuit board 121 and can deflect into the recess 24*a* in a resiliently movable manner.

In longitudinal walls of the housing component 120, said housing component has mutually opposing openings 110, through which in each case one of the elements 130 of the contact device 32 protrudes from an outer side of the lighting module 112 after assembly of the lighting module 112.

The second lighting module 112 also has a plug connecting device 115*b* which is arranged at the end 112*b* and is designed by way of example as a female plug connector. One end 121*b* of the printed circuit board 121 corresponds to the end 112*b* of the lighting module 112 when said lighting module is in the assembled state. The connecting device 115*b* is arranged on and fastened to the printed circuit board 121 at the end 121*b*.

The connecting device 115*b* of the second module 112 is designed to correspond to the connecting device 115*a* of the first module 102, and the female plug connector 115*b* can be connected to the male plug connector 115*a*. The devices 115*a*, 115*b* can thus be plugged one inside the other for electrical coupling of the lighting modules 102, 112, e.g. by inserting both the lighting modules 102, 112 into the inner space 125 of the rail 109 and then displacing them towards one another.

A further plug connecting device 115*a*, designed as a male plug connector, in particular similarly to that of the first module 102, is arranged at the first end 112*a* of the second lighting module 112. An end 121*a* of the circuit board 121 corresponds to the end 112*a* of the module 112, wherein the connecting device 115*a* of the second module 112 is arranged at the end 121*a* on the circuit board 121. If required, a further second lighting module 112 can be plugged at the end 112*a* and thus electrically coupled.

The first lighting module 102 is configured to receive electric current from the conductor device 126 via the first contact means 30 in order to supply the module 102. Furthermore, the first lighting module 102 is configured to receive the control signal from the conductor device 126 via the second contact device 31. The second lighting module 112 is configured to receive electric current from the conductor device 126 via the third contact means 32 in order to supply the second lighting module 112.

An electronic arrangement 70 comprising electronic components, in particular control electronics, is provided on the board 21 of the first lighting module 102. The arrangement 70 is configured to process the control signal, e.g. the DALI signal, received from the conductor device 126 via the contact device 31, in terms of at least interpreting the control signal. Depending on the control signal received and processed at least in terms of interpreting same, the first lighting module 102 is controlled, e.g. dimmed.

Furthermore, by means of the electronic arrangement 70 an output signal is provided in dependence upon the received and interpreted control signal, said output signal being directed to the second lighting module 112 via the coupling by means of the plug connecting devices 115*a*, 115*b* plugged one inside the other at the ends 102*a* and 112*b*. The second lighting module 112 is controlled on the basis of the signal transferred via the devices 115*a*, 115*b*. In this way, the control signal applied to the conductor device 126 can be received by the first module 102 and translated for the control of also the second module 112.

The first lighting module 102 is operated as a "master" module, whereas the second lighting module 112 forms a "slave" module which is subordinate to the first module 102. In the exemplified shown in the figures, the second lighting module 112 is not equipped with an arrangement 70 for interpreting control signals, such as DALI signals, provided at the conductor device 126, and moreover, in the case of the second lighting module 112 according to the exemplified embodiment shown a contact device for tapping such control signals at the conductor device 126 is omitted. In this way, relatively expensive electronic components and corresponding costs, in particular for interpreting the control signal, can be saved in the second lighting module or "slave" inset 112 and the complexity of the modules 112 can be reduced.

The output signal which is provided by the first module 102 and by means of which the second lighting module 112 can be controlled as a "slave" together with the first lighting module 102 as a "master", can be based e.g. upon a pulse width modulation or a pulse pause modulation. For example, the output signal can be provided in the form of a signal correlating to a dim level and can be transferred to the second module 112.

If desired, a further "slave" lighting module 112 can be controlled via the further connecting device 115*a* at the end 112*a*.

While the second lighting module 112 is directly coupled to the operating current provisioning conductors 126*a* in order to be supplied with energy, the second module 112 is controlled via and together with the first module 102.

The lighting modules 102, 112 each have one or more lighting device(s), which are formed as LEDs in strips on the printed circuit boards 21 and 121 using the chip-on-board method, whereby a uniform light emission without visible light spots can be achieved. In the exemplified embodiment, the insets 102, 112 and the rail 109 are elongate with relatively small cross-sectional dimensions. In such a design, chip-on-board lighting devices are highly suitable for achieving an attractive, uniform lighting effect.

The lighting arrangement 100 can thus save costs for expensive electronic components and at the same time achieve controllability and a flexible, modular structure. In addition, the structure described above, in particular the lighting modules 102, 112, permits a design which is not only economical and efficient but also space-saving, which is advantageous particularly in the case of a slender and elegant shape for the lighting system 100.

It is also feasible, in a further variant of the lighting arrangement 100, to insert a plurality of lighting modules 102 into the rail 109. In the case of such a variant, e.g. each of the first lighting modules 102 can be coupled to one or more second lighting modules 112 in the manner described above. Alternatively, provision can be made e.g. that at least one of the first lighting modules 102 is coupled to one or more second lighting modules 112 in the manner described above, while at least one further one of the first lighting modules 102 is used without a second lighting module 112 coupled thereto. In this way, e.g. the lighting effects and control options can be varied in many ways.

Although the invention has been described in full above with the aid of preferred exemplified embodiments, it is not limited thereto but can be modified in diverse ways.

The exemplified embodiments have been selected and described in order to be able to illustrate in the best way possible the principles addressed by the invention and its possible applications in practice. This enables those skilled in the art to optimally modify and utilise the invention and its various exemplified embodiments with respect to the intended use. In the claims as well as the description, the terms "including" and "having" are used as neutral language terms for the corresponding terms "comprising". Furthermore, a use of the terms "a" and "one" shall not fundamentally exclude a plurality of such described features and components.

LIST OF REFERENCE SIGNS

10 opening
20 housing component (first lighting module)
21 printed circuit board (first lighting module)
21*a, b* end (printed circuit board)
24*a, b* recess (printed circuit board)
30 contact device
31 contact device
32 contact device
50 cover (first lighting module)
70 electronic arrangement
100 lighting arrangement
102 first lighting module
102*a, b* end (first lighting module)
109 rail
110 opening
112 second lighting module
112*a, b* end (second lighting module)
115*a, b* connecting device
120 housing component (second lighting module)
121 printed circuit board (second lighting module)
121*a, b* end (printed circuit board)
125 inner region
126 conductor device
126*a* conductor (for operating current)
126*b* conductor (for control signal)
126*c* base body
129 clip element
130, 131 contact element
150 cover (second lighting module)
L Longitudinal direction
M longitudinal centre plane
S visible side

The invention claimed is:

1. Lighting arrangement, comprising a first lighting module and at least one second lighting module, and comprising a rail which is designed for coupling and/or at least partially accommodating the first lighting module and the at least one second lighting module; wherein a conductor device is provided along the rail for providing electric current and a control signal; wherein the first lighting module is configured to be coupled to the conductor device in order to receive electric current for supplying the first lighting module and the control signal from the conductor device, wherein the first lighting module has a first contact device, by means of which each of one or more operating current provisioning conductors of the conductor device can be electrically conductively contacted, and also has a second contact device, by means of which each of one or more control signal provisioning conductors of the conductor device can be electrically conductively contacted;

wherein the at least one second lighting module is configured to be coupled to the conductor device in order to receive electrical energy for supplying the second lighting module from the conductor device, wherein the at least one second lighting module has a third contact device, by means of which the operating current provisioning conductor(s) of the conductor device can each be electrically conductively contacted;

wherein the first lighting module is further configured to process the control signal and to control the first lighting module in dependence upon the control signal;

and wherein the first and the at least one second lighting module are configured to be coupled to one another in such a way that a signal for controlling the at least one second lighting module can be communicated from the first lighting module to the at least one second lighting module.

2. Lighting arrangement as claimed in claim 1, wherein the at least one second lighting module can be controlled together with the first lighting module according to a master-slave principle, wherein the at least one second lighting module as the slave is subordinate to the first lighting module as the master.

3. Lighting arrangement as claimed in claim 1, wherein the first lighting module has an electronic arrangement, by means of which the control signal received from the conductor device can be processed, and the first lighting module can be controlled depending upon the control signal, and wherein the signal to be communicated to the at least one second lighting module can be provided by means of the electronic arrangement.

4. Lighting arrangement as claimed in claim 1, wherein the first lighting module and/or the at least one second lighting module each have a printed circuit board and the contact devices comprise contact elements arranged in an elastically movable manner on the printed circuit board, wherein the contact elements are each arranged in a region of a respectively allocated recess in an edge of the printed circuit board.

5. Lighting arrangement as claimed in claim 1, wherein the conductor device has at least two operating current provisioning conductors and two control signal provisioning conductors, and in particular in that the operating current provisioning conductors.

6. Lighting arrangement as claimed in claim 1, wherein when the lighting modules are in an inserted state, the conductor device is arranged laterally on both sides of the lighting modules.

7. Lighting arrangement as claimed in claim 1, wherein the first lighting module and the at least one second lighting module are each designed having at least one connecting device, wherein the connecting devices of the first and the at least one second lighting module are designed to correspond to one another and the at least one second lighting module can be connected by means of the connecting devices to the first lighting module for the purpose of transmitting the signal for the control of the second lighting module.

8. Lighting arrangement as claimed in claim 7, wherein the connecting devices are each arranged at an end-face end of the first or at least one second lighting module.

9. Lighting arrangement as claimed in claim 1, wherein the first lighting module and the at least one second lighting module are each designed as a lighting inset, the conductor device is arranged in an inner region of the rail, and the lighting insets can be inserted into the inner region of the rail.

10. Lighting arrangement as claimed in claim 1, wherein the first lighting module and the at least one second lighting module are each elongate.

11. Lighting arrangement as claimed in claim 1, wherein the rail is designed as a low-voltage rail.

12. Lighting arrangement as claimed in claim 1, wherein the first lighting module and the at least one second lighting module are each formed with one strip lighting device or a plurality of strip lighting devices which are made by a chip-on-board method.

13. Lighting arrangement as claimed in claim 1, wherein the lighting arrangement has a plurality of first lighting modules and/or a plurality of second lighting modules.

14. Lighting arrangement as claimed in claim 1, wherein the first lighting module is further configured to interpret the control signal received from the conductor device.

15. Lighting arrangement as claimed in claim 3, wherein the electronic arrangement is configured to interpret the control signal received from the conductor device.

16. Lighting arrangement as claimed in claim 4, wherein the contact elements protrude through openings of a housing component of the lighting module on one or both longitudinal sides thereof from an outer side of the lighting module.

17. Lighting arrangement as claimed in claim 5, wherein the operating current provisioning conductors and control signal provisioning conductors are arranged symmetrically with respect to a longitudinal center plane of the rail.

18. A lighting arrangement, comprising:

a first lighting module and at least one second lighting module, and comprising a rail which is designed for coupling and/or at least partially accommodating the first lighting module and the at least one second lighting module;

wherein a conductor device is provided along the rail for providing electric current and a control signal;

wherein the first lighting module is configured to be coupled to the conductor device in order to receive electric current for supplying the first lighting module and the control signal from the conductor device, wherein the first lighting module has a first contact device, by means of which one or more operating current provisioning conductors of the conductor device can each be electrically conductively contacted, and also has a second contact device, by means of which one or more control signal provisioning conductors of the conductor device can each be electrically conductively contacted;

wherein the first lighting module has a printed circuit board and the contact devices comprise contact elements arranged in an elastically movable manner on the printed circuit board, wherein the contact elements are each arranged in a region of a respectively allocated recess in an edge of the printed circuit board, and wherein the contact elements protrude through openings of a housing component of the first lighting module on one or both longitudinal sides thereof from an outer side of the first lighting module;

wherein the first lighting module is further configured to process the control signal and to control the first lighting module in dependence upon the control signal; and wherein the first and the at least one second lighting module are configured to be coupled to one another in such a way that a signal for controlling the at least one second lighting module can be communicated from the first lighting module to the at least one second lighting module.

19. The lighting arrangement as claimed in claim 18, wherein the at least one second lighting module is configured to be coupled to the conductor device in order to receive electrical energy for supplying the second lighting module from the conductor device, wherein the at least one second lighting module has a third contact device, by means of which the operating current provisioning conductor(s) of the conductor device can each be electrically conductively contacted, and further wherein the at least one second lighting module has a printed circuit board and the contact device comprises contact elements arranged in an elastically movable manner on the printed circuit board, wherein the contact elements are each arranged in a region of a respectively allocated recess in an edge of the printed circuit board, and wherein the contact elements protrude through openings of a housing component of the second lighting module on one or both longitudinal sides thereof from an outer side of the second lighting module.

20. The lighting arrangement as claimed in claim 18, wherein the first lighting module is further configured to interpret the control signal received from the conductor device and has an electronic arrangement, by means of which the control signal received from the conductor device can be interpreted and the first lighting module can be controlled depending upon the control signal.

21. The lighting arrangement as claimed in claim 18, wherein the first lighting module and the at least one second lighting module are each designed as a lighting inset, the conductor device is arranged in an inner region of the rail, and the lighting insets can be inserted into the inner region of the rail.

* * * * *